US009363598B1

(12) United States Patent
Yang

(10) Patent No.: US 9,363,598 B1
(45) Date of Patent: Jun. 7, 2016

(54) ADAPTIVE MICROPHONE ARRAY COMPENSATION

(71) Applicant: Rawles LLC, Wilmington, DE (US)

(72) Inventor: Jun Yang, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 110 days.

(21) Appl. No.: 14/176,797

(22) Filed: Feb. 10, 2014

(51) Int. Cl.
*H04R 3/00* (2006.01)

(52) U.S. Cl.
CPC ..... *H04R 3/005* (2013.01)

(58) Field of Classification Search
None
See application file for complete search history.

(56) References Cited

U.S. PATENT DOCUMENTS 7,203,323 B2 * 4/2007 Tashev ..... H04R 1/406 381/92
7,418,392 B1 8/2008 Mozer et al.
7,720,683 B1 5/2010 Vermeulen et al.
7,774,204 B2 8/2010 Mozer et al.
8,321,214 B2 * 11/2012 Chan ..... H04R 3/005 704/225
8,411,880 B2 * 4/2013 Wang ..... H03G 3/32 381/122
8,515,093 B2 * 8/2013 Bhandari ..... H04R 3/005 381/102
8,731,210 B2 * 5/2014 Cheng ..... H04R 3/005 381/107
2011/0075859 A1 * 3/2011 Kim ..... H04R 3/005 381/92
2012/0223885 A1 9/2012 Perez
2014/0341380 A1 * 11/2014 Zheng ..... H04R 29/006 381/56
2015/0117671 A1 * 4/2015 Chen ..... H04L 12/1813 381/92

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.
Tashev, "Gain Self-Calibration Procedure for Microphone Arrays", Microsoft Research, Redmond, WA USA, Jun. 2004, 4 pages.
Hua, et al. "A New Self-Calibration Technique for Adaptive Microphone Arrays", Media and Information Research Labs, NEC Japan and LTSI, Unviersite de Rennes I, France, 4 pages.
Tashev, "Beamformer Sensitivity to microphone Manufacturing Tolerances", Microsoft Research, USA 5 pages.

* cited by examiner

*Primary Examiner* — Brenda Bernardi
(74) *Attorney, Agent, or Firm* — Lee & Hayes, PLLC

(57) ABSTRACT

An audio-based system may perform audio beamforming and/or sound source localization based on multiple input microphone signals. Each input microphone signal can be calibrated to a reference based on the energy of the microphone signal in comparison to an energy indicated by the reference. Specifically, respective gains may be applied to each input microphone signal, wherein each gain is calculated as a ratio of a energy reference to the energy of the input microphone signal.

19 Claims, 7 Drawing Sheets

ADAPTIVE MICROPHONE ARRAY COMPENSATION

BACKGROUND

Audio beam-forming and sound source localization techniques are widely deployed in conjunction with applications such as teleconferencing and speech recognition. Beamforming and sound source localization typically use microphone arrays having multiple omni-directional microphones. For optimum performance, the microphones of an array and their associated pre-amplification circuits should be precisely matched to each other. In practice, however, manufacturing tolerances allow relatively wide variations in microphone sensitivities. In addition, responses of microphone and pre-amplifier components vary with external factors such as temperature, atmospheric pressure, power supply variations, etc. The resulting mismatches between microphones of a microphone array can greatly degrade the performance of beamforming, sound source localization, and other sound processing techniques that rely on input from multiple microphones.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Described herein are techniques for adaptively compensating multiple microphones of an array so that the microphones produce similar responses to received sound. The described techniques may be used to provide calibrated and equalized microphone signals to sound processing components that produce signals and/or other data that are dependent on the locations from which received sounds originate. For example, the described techniques may be used to increase the performance and accuracy of audio beamformers and sound localization components.

In one embodiment, multiple microphone signals produced by a microphone array are adaptively and continuously calibrated to an energy reference. The energy reference may be received as a value or may be derived from the energy of a received reference signal. In some cases, any one of the microphones of the microphone array may be selected as a reference, and the corresponding microphone signal may be used as a reference signal.

A gain is calculated and applied to each microphone signal. The gain is calculated separately for each microphone signal such that after applying each gain, the energies of all the microphone signals are approximately equal. For an individual microphone signal, the gain may be calculated as the ratio of the energy reference to the energy of the microphone signal.

In another embodiment, multiple microphone signals can be calibrated and equalized across multiple frequencies. In an embodiment such as this, a reference signal is evaluated to determine reference energies at each of multiple frequencies. Similarly, each microphone signal is evaluated to determine signal energies at each of the multiple frequencies. For each microphone signal, at each frequency, the microphone signal is compensated based on the ratio of the energy of the reference signal and the energy of the microphone signal.

Figure 1:
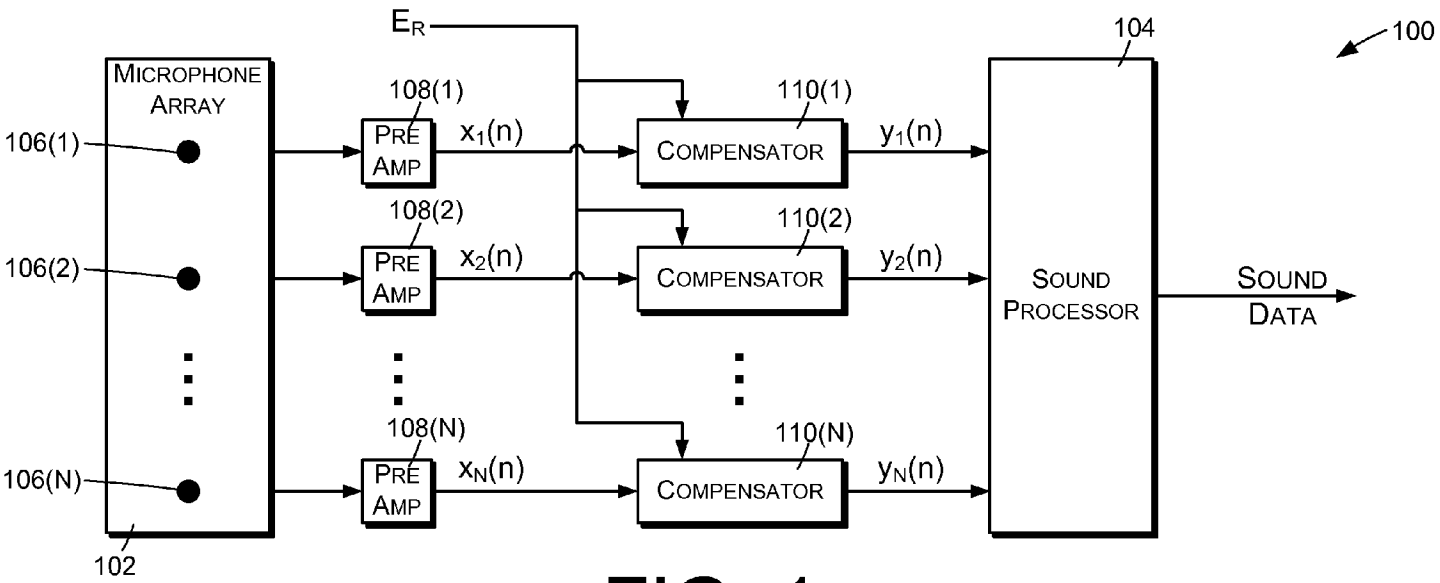
FIG. 1 is a block diagram illustrating a first example system and method for adaptively calibrating multiple microphones of an array.

FIG. 1 shows an example system 100 having a microphone array 102 that produces audio signals for use by a sound processor or other audio processing component 104. The sound processor 104 is responsive to microphone signals from multiple microphones 106 of the array 102 to process audio in a manner that depends on or responds to the locations from which received sounds originate. In one embodiment, the sound processor 104 may comprise an audio beamformer that filters multiple microphone signals to produce one or more audio signals that emphasize sound received by the microphone array 102 from corresponding directions, locations, or spatial regions. For example, the audio beamformer may be used to perform the audio beamforming process described below. In other embodiments, the sound processor 104 may comprise a sound source localizer or localization component that determines the source directions, locations, or coordinates of speech or other sounds that occur within the environment of the microphone array 102.

Generally, the sound processor 104 produces data regarding sound received by the microphone array 102. The data may comprise, as an example, by one or more digital audio signals that emphasize sounds originating from respective locations or directions. As another example, the data may comprise location data, such as positions or coordinates from which sounds originate.

Audio beamforming, also referred to as audio array processing, uses a microphone array having multiple microphones that are spaced from each other at known distances. Sound originating from a source is received by each of the microphones. However, because each microphone is at a different distance from the sound source, a propagating sound wave arrives at each of the microphones at slightly different times. This difference in arrival times results in phase differences between audio signals produced by the microphones. The phase differences can be exploited to enhance sounds originating from selected directions relative to the microphone array.

For example, beamforming may use signal processing techniques to combine signals from the different microphones so that sound signals originating from a particular direction are emphasized while sound signals from other directions are deemphasized. More specifically, signals from the different microphones are phase-shifted by different amounts so that signals from a particular direction interfere constructively, while signals from other directions experience interfere destructively. The phase shifting parameters used in beamforming may be varied to dynamically select different directions, even when using a fixed-configuration microphone array.

Differences in sound arrival times at different microphones can also be used for sound source localization. Differences in arrival times of a sound at the different microphones are determined and then analyzed based on the known propagation speed of sound to determine a point from which the sound originated. This process involves first determining differences in arrivals times using signal correlation techniques between the different microphone signals, and then using the time-of-arrival differences as the basis for sound localization.

The microphone array 102 may comprise a plurality of microphones 106 that are spaced from each other in a known or predetermined configuration. For example, the microphones 106 may be in a linear configuration or a circular configuration. In some embodiments, the microphones 106 of the array 102 may be positioned in a single plane, in a two-dimensional configuration. In other embodiments, the microphones 106 may be positioned in multiple planes, in a three-dimensional configuration. Any number of microphones 106 may be used in the microphone array 102.

In the illustrated embodiment, the microphone array has N microphones, referenced as 106(1)-106(N). The microphones 106 produce N corresponding input microphone signals, referenced as $x_1(n)$-$x_N(n)$. The signals $x_1(n)$-$x_N(n)$ may be subject to pre-amplification or other pre-processing by pre-amplifiers 108(1)-108(N), respectively.

The signals shown and discussed herein, including the input microphone signals as $x_1(n)$-$x_N(n)$, are assumed for purposes of discussion to be digital signals, comprising continuous sequences of digital amplitude values. Accordingly, the nomenclature "x(n)" indicates the $n^{th}$ value of a sequence of digital amplitude values. The nomenclature $x_m$ indicates the $m^{th}$ of N such digital signals. $x_m(n)$ indicates the $n^{th}$ value of the $m^{th}$ signal. Similar nomenclature will be used with reference to other signals in the following discussion. Generally, the $n^{th}$ values of any two signals correspond in time with each other: x(n) corresponds in time to y(n).

The system 100 has microphone compensators or compensation components 110(1)-110(N) corresponding respectively to the microphones 106(1)-106(N) and input microphone signals $x_1(n)$-$x_N(n)$. Each microphone compensator 110 receives a corresponding one of the input microphone signals x(n) and produces a corresponding compensated microphone signal y(n). Compensation is performed by applying calibrated gains to the microphone signals, thereby increasing or decreasing the amplitudes of the microphone signals so all of the microphone signals exhibit approximately equal signal energies.

In the example of FIG. 1, the microphone compensators 110 are responsive to a energy reference $E_R$, which indicates a desired calibrated signal energy. The energy reference $E_R$ may comprise a value indicating a relative energy, such as a percentage of a maximum energy. In some cases, the energy reference $E_R$ may comprise a value from 0.0 to 1.0, indicating a range from zero to full energy. The energy reference $E_R$ may be adjustable or variable.

The microphone compensators 110 are configured to calculate and apply a gain to each of the microphone signals $x_1(n)$-$x_N(n)$. The gain is calculated so that each of the compensated microphone signals y(n) is maintained at an energy that is approximately equal to the energy reference $E_R$. The microphone compensators 110 implement adaptive and time-varying gain calculations so that the compensated microphone signals y(n) remain calibrated with each other and with $E_R$ over time, despite varying environmental conditions such as varying temperatures.

The compensated microphone signals y(n) are received by the sound processor 104 or other audio analysis components and used as the basis for discriminating between sounds from different directions or locations or for identifying the directions or locations from which sounds have originated.

Figure 2:
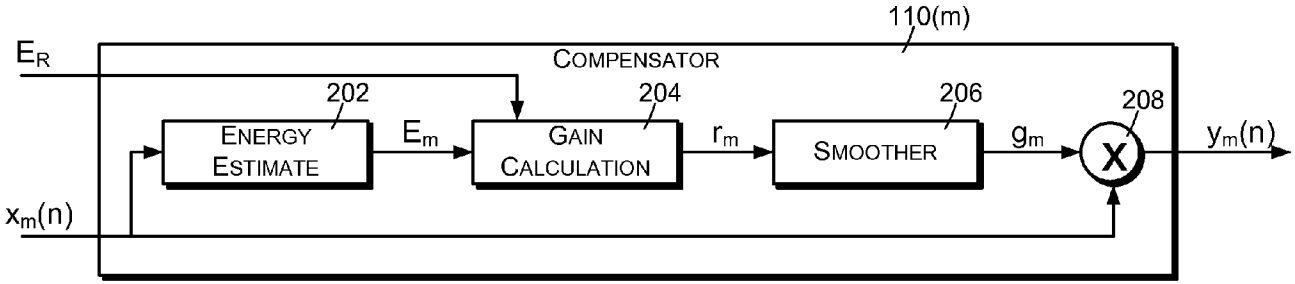
FIG. 2 is a block diagram illustrating an example implementation of a microphone signal compensator such as may be used in the example system and method of FIG. 1.

FIG. 2 shows an example implementation of a microphone compensator 110(*m*). The microphone compensator 110(*m*) receives one of the input microphone signals $x_m(n)$. An energy estimation component 202 estimates the energy of the input microphone signal $x_m(n)$. The energy estimation is performed with respect to a block or frame of input microphone signal values, wherein such a block comprises a number M of consecutive input microphone signal values. The block energy $E_m$ is calculated as a function of the sum of the squared values $x_m(n)$ of the frame or block of input microphone signal values as follows:

$$E_m = \sum_{n=0}^{M-1} x_m^2(n)/M \qquad \text{Equation 1}$$

where M is the size of the frame or block of samples. For example, a block may comprise 256 consecutive signal values.

$E_m$ is an indication of energy or power relative to other signals whose energies are calculated based on the same function. The function above estimates $E_m$ by averaging the squared values of $x_m(n)$ over a frame or block. However, energy may be estimated in different ways. As another example, the signal energy $E_m$ may be estimated by averaging the absolute values of the signal values $x_m(n)$ over the frame or block.

The estimated block energy $E_m$ is received by a gain calculation component 204 that is configured to calculate a preliminary gain $r_m$ based on the energy reference $E_R$ and the estimated block energy $E_m$. For example, the preliminary gain $r_m$ may comprise a ratio of $E_R$ and $E_M$ as follows:

$$r_m = E_R/E_M \qquad \text{Equation 2}$$

The preliminary gain $r_m$ is received by a smoothing component 206 that is configured so smooth the preliminary gain $r_m$ over time to produce an adaptive signal gain $g_m(n)$ as follows:

$$g_m(n) = r_m * \alpha + g_m(n-1) * (1-\alpha) \qquad \text{Equation 3}$$

where $\alpha$ is a smoothing factor between 0.0 and 1.0, e.g. 0.90, and $g_m(n)$ is the adaptive gain for each value of the $m^{th}$ microphone signal.

An amplification or multiplication component 208 multiplies the microphone signal $x_m(n)$ by the adaptive gain $g_m(n)$ to produce the compensated signal value $y_m(n)$. More specifically, for each microphone value $x_m(n)$, the corresponding compensated signal value $y_m(n)$ is as follows:

$$y_m(n) = g_m(n) * x_m(n) \qquad \text{Equation 4}$$

Figure 3:
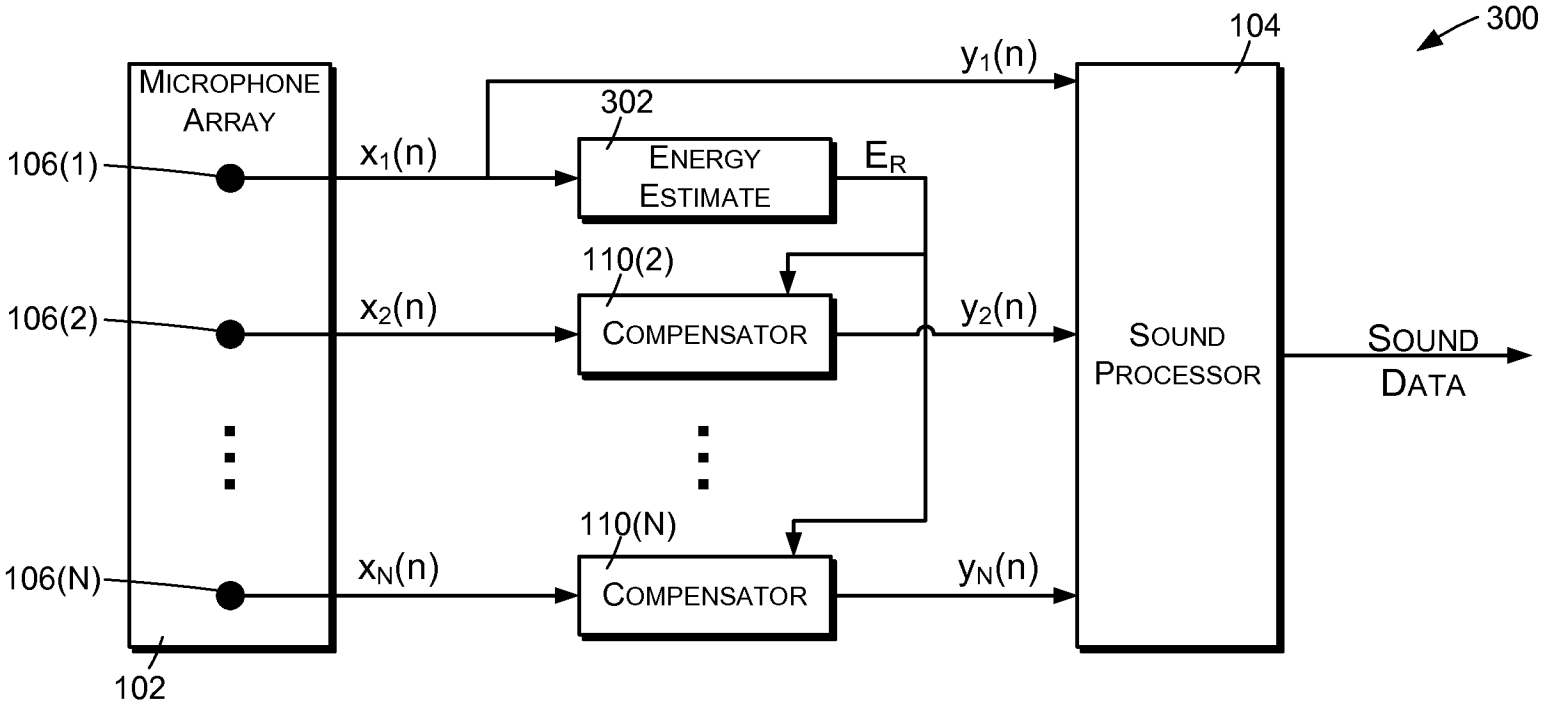
FIG. 3 is a block diagram illustrating a second example system and method for adaptively calibrating multiple microphones of an array.

FIG. 3 shows an alternative example of a system 300 that is similar to the example of FIG. 1 except that the energy reference $E_R$ is established by an estimated block energy of a selected one of the microphone signals x(n), which in this case comprises a first of the microphone signals $x_1(n)$. More specifically, the energy reference $E_R$ is calculated by a reference generator or energy estimation component 302 as a function of the sum of the squared values of $x_1(n)$ over a block of signal values of $x_1(n)$ as follows:

$$E_R = \sum_{n=0}^{M-1} x_1^2(n)/M \quad \text{Equation 5}$$

where M is the size of the frame or block of signal values. For example, a block may comprise 256 consecutive signal values The energy reference $E_R$ is calculated using the same function as used when calculating the energy $E_m$ of the microphone signals. In cases where the microphone signal energy $E_m$ is estimated by averaging the absolute values of the signal values $x_m(n)$, the energy reference $E_R$ is similarly estimated by averaging the absolute values of $x_1(n)$.

Microphone compensators 110(2)-110(N), each of which is implemented as shown in FIG. 2, receive the input microphone signals $x_2(n)$ through $x_N(n)$ and apply a gain $g_m$ that is calculated as already described, in this case as a function of the block energy $E_R$ of the first microphone signal $x_1(n)$ and the block energy $E_m$ of the input microphone signal $x_m(n)$. No gain or compensation is applied to the first microphone signal $x_1(n)$:

$$y_1(n)=x_1(n) \quad \text{Equation 6}$$

Figure 4:
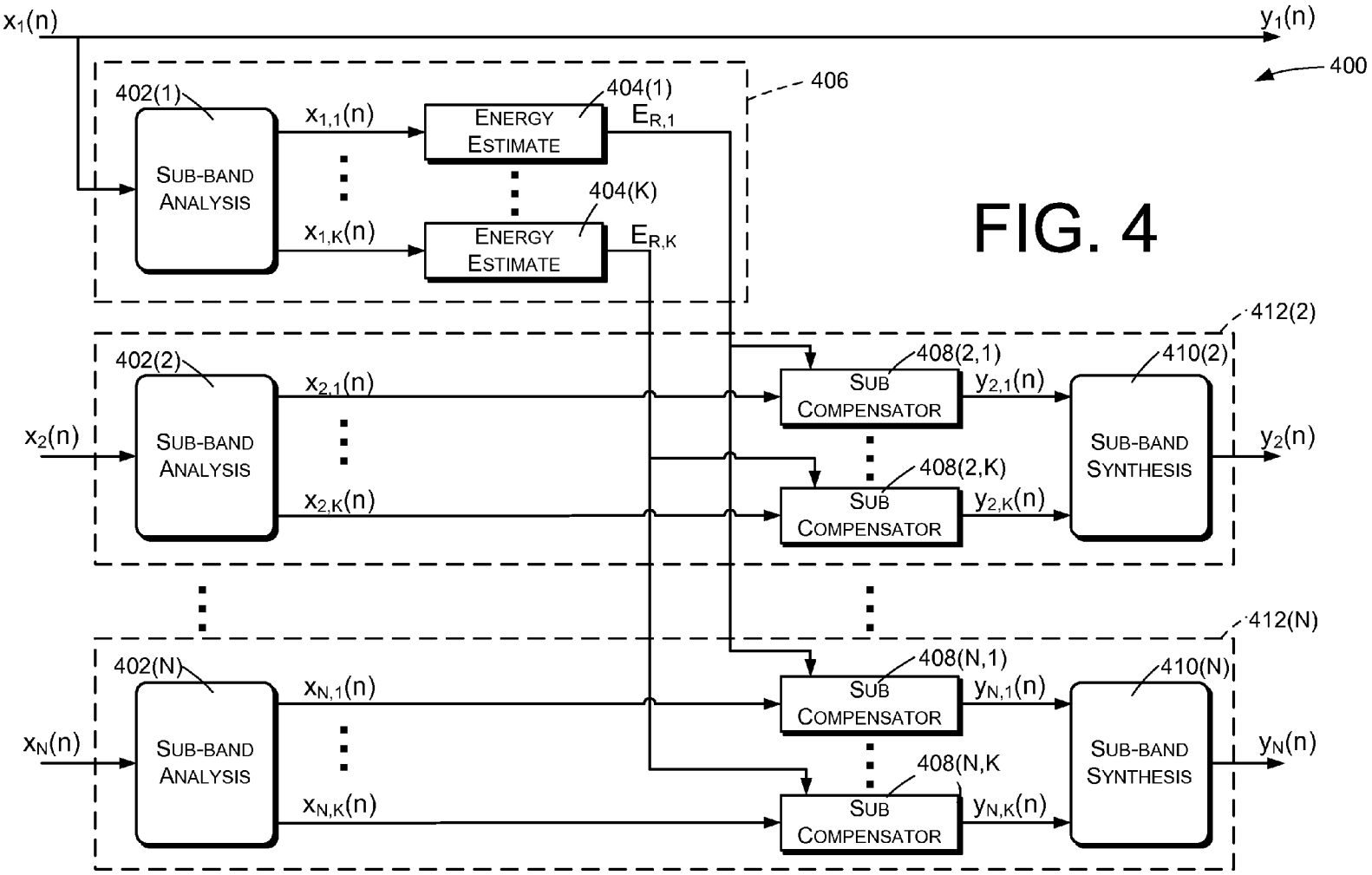
FIG. 4 is a block diagram illustrating a third example system and method for adaptively calibrating multiple microphones of an array.

FIG. 4 shows an example system 400 that is configured to calibrate multiple microphones or microphone signals and to equalize the microphones or signals across different frequencies or frequency bands. The system 400 receives multiple microphone signals $x_1(n)$ through $x_N(n)$ as described above with reference to FIGS. 1-3. In this embodiment, the first microphone signal $x_1(n)$ is used as a reference signal, and the remaining microphone signals $x_2(n)$ through $x_N(n)$ are calibrated to dynamically estimated signal energies of the first microphone signal $x_1(n)$.

Each microphone signal $x_1(n)$-$x_N(n)$ is received by a corresponding sub-band analysis component 402(1)-402(N). Each sub-band analysis component 402(*m*) operates in the same manner to decompose its received microphone signal $x_m(n)$ into a plurality of microphone sub-signals $x_{m,1}(n)$ through $x_{m,K}(n)$, where m indicates the $m^{th}$ microphone signal and K is the number of frequency bands and sub-signals that are to be used in the system 400. The $j^{th}$ sub-signal of the $m^{th}$ microphone signal is referred to as $x_{m,j}(n)$.

Each microphone sub-signal represents a frequency component of the corresponding microphone signal. Each microphone sub-signal corresponds to a particular frequency, which may correspond to a frequency bin, band, or range. The $j^{th}$ sub-signal corresponds to the $j^{th}$ frequency, and represents the component of the microphone signal corresponding to the $j^{th}$ frequency. Each sub-band analysis component 402 may be implemented as either an FIR filter bank or an infinite impulse response (IIR) filter bank.

The microphone sub-signals $x_{1,1}(n)$-$x_{1,K}(n)$, corresponding to the first microphone signal $x_1(n)$, are received respectively by energy estimation components 404(1) through 404(K), which produce reference energies $E_{R,1}$-$E_{R,K}$ corresponding respectively to the K frequencies or frequency bands. Each energy reference $E_{R,j}$ is calculated over a block of signal values as a function of the sum of the squares of the values, as follows:

$$E_{R,j} = \sum_{n=0}^{M-1} x_{1,j}^2(n)/M \quad \text{Equation 7}$$

where M is the size of the frame or block of signal values. For example, a block may comprise 256 consecutive signal values. The sub-band analysis component 402(1) and associated energy estimation components 404(1) through 404(K) may be referred to as a energy reference generator 406.

The microphone sub-signals $x_{2,1}(n)$-$x_{2,x}(n)$ corresponding to the second microphone signal $x_2(n)$ are received respectively by sub-compensators or sub-compensation components 408(2, 1)-408(2, K), which produce compensated microphone sub-signals $y_{2,1}(n)$-$y_{2,K}(n)$. Each sub-compensator 408 comprises a compensation component such as shown in FIG. 2 to adaptively calculate and apply a gain based on the energy reference $E_{R,j}$ and the corresponding microphone sub-signal $x_{2,j}(n)$.

A sub-band synthesizer component 410(2) receives the compensated microphone sub-signals $y_{2,1}(n)$-$y_{2,K}(n)$ and synthesizes them to create a compensated microphone signal $y_2(n)$ corresponding to the input microphone signal $x_2(n)$. The sub-band synthesizer component 410(2) combines or sums the values of the microphone sub-signals $y_{2,1}(n)$ $\gamma_{2,K}(n)$ to produce the compensated microphone signal $y_2(n)$.

Each of the microphone signals $x_3(n)$-$x_N(n)$ is processed in the same manner as described above with reference to the processing of the second microphone signal $x_2(n)$ to produce corresponding compensated microphone signals $y_3(n)$-$y_N(n)$. The first microphone signal $x_1(n)$ is used without processing to form the first compensated microphone signal $y_1(n)$:

$$y_1(n)=x_1(n) \quad \text{Equation 8}$$

Although the calculations above are performed with respect to time domain signals, the various calculations may also be performed in the frequency domain.

For each of the microphone signals $x_2(n)$-$x_N(n)$, the corresponding sub-band-analysis component 402, sub-compensators 408, and sub-band synthesizer component 410 may be considered as collectively forming a multiple-band signal compensator or compensation component 412. Thus, each of microphone signals $x_2(n)$-$x_N(n)$ is received by a multiple-band signal compensator 412 to produce a corresponding frequency band compensated microphone signal y(n).

Figure 5:
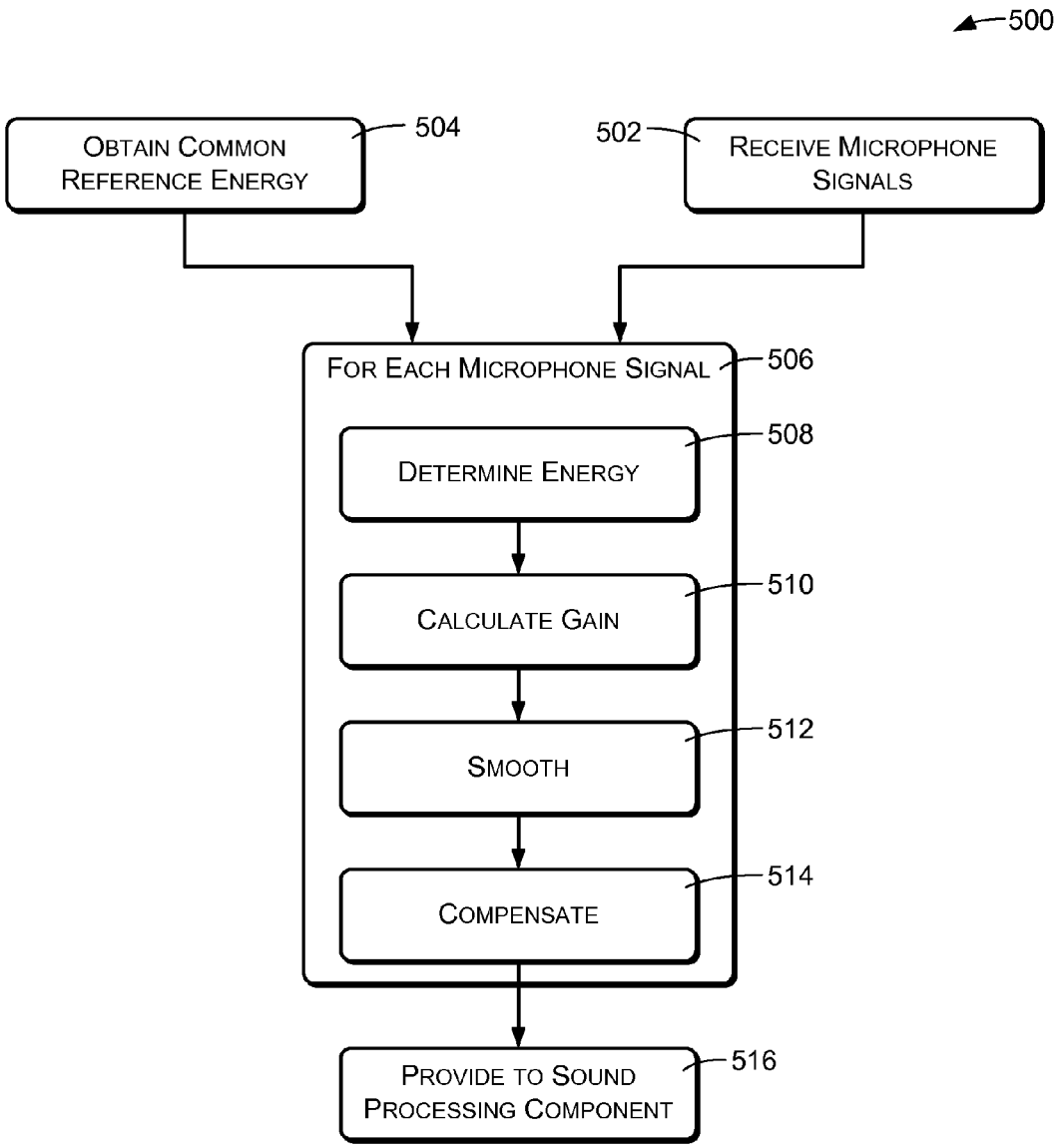
FIG. 5 is a flowchart illustrating an example of adaptively compensating multiple microphones of a microphone array.

FIG. 5 illustrates an example method 500 of calibrating multiple microphone signals. An action 502 comprises receiving a plurality of microphone signals. The microphone signals may be provided by and received from a microphone array as described above.

An action 504 comprises obtaining a common energy reference. The action 504 may comprise receiving an energy reference value, which may be expressed or specified as a percentage or fraction of a full or maximum signal energy. Alternatively, the action 504 may comprise receiving a reference signal and calculating the common energy reference based on the energy of the reference signal. In some cases, a microphone of a microphone array may be selected as a reference microphone, and the corresponding microphone signal may be used as a reference signal from which the energy reference is derived.

A set or sequence of actions 506 are performed with respect to each of the received microphone signals. However, in the case where one of the microphone signals is used as a reference signal, the actions 506 are not applied to the reference microphone signal.

An action 508 comprises determining an energy of the microphone signal. This may be performed by evaluating a block of microphone signal values, and may include squaring, summing, and averaging the signal values of the block as described above.

An action 510 comprises calculating a preliminary gain, which may be based at least in part on the common energy reference and the energy of the microphone signal as determined in the action 508. More specifically, the preliminary gain may be calculated as the ratio of the common energy reference to the energy of the microphone signal. An action 512 comprises smoothing the preliminary gain over time to produce an adaptive signal gain.

An action 514 comprises compensating the microphone signal by applying the adaptive signal gain to produce a compensated microphone signal. The action 514 may comprise amplifying or multiplying the microphone signal by the adaptive signal gain.

After compensating the multiple microphone signals in the actions 506, an action 516 comprises providing the compensated microphone signals to a sound processing component such as an audio beamformer or sound localization component.

Figure 6:
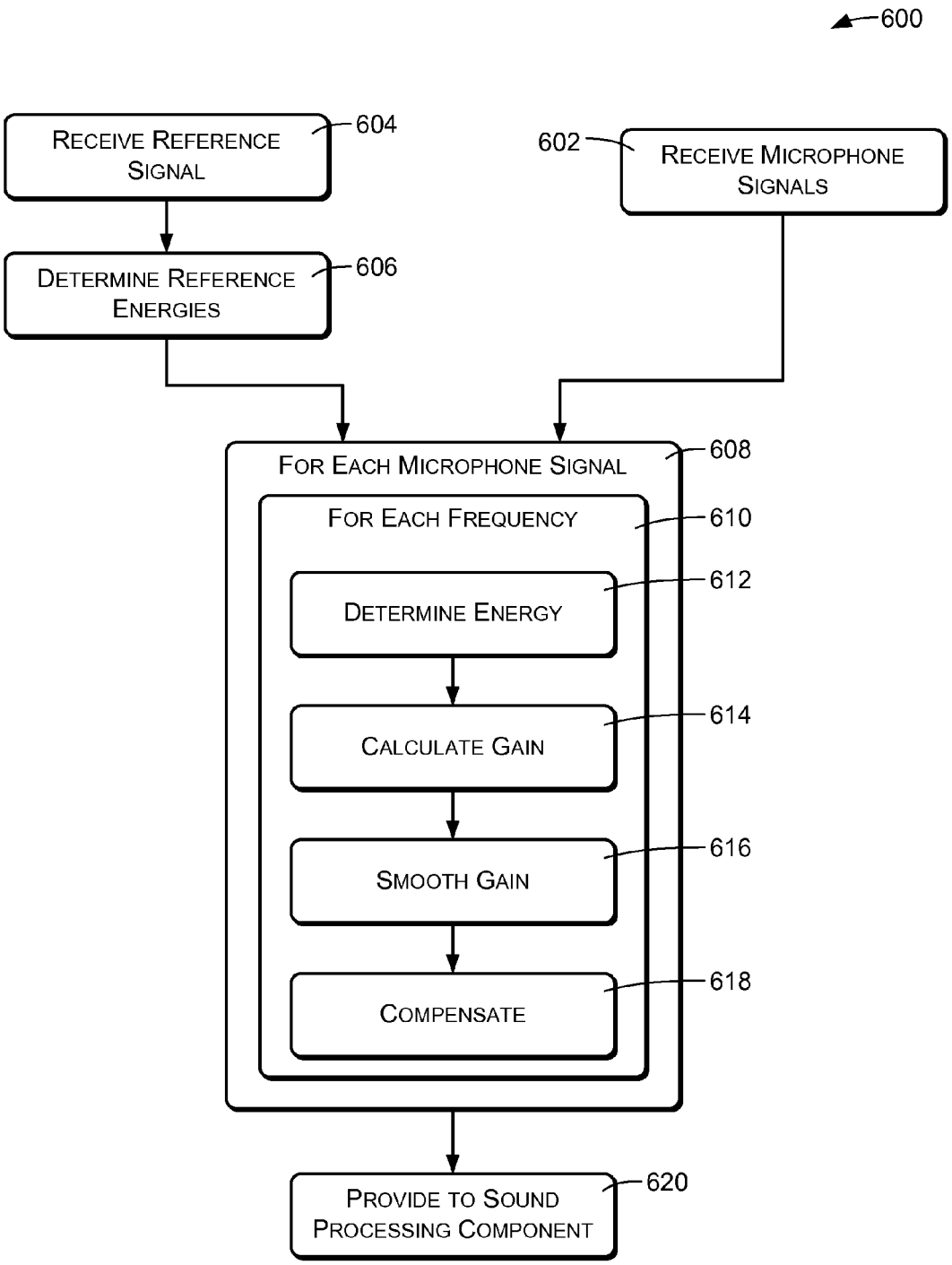
FIG. 6 is a flowchart illustrating an example of adaptively compensating multiple microphones of a microphone array across multiple frequencies.

FIG. 6 illustrates an example method 600 of calibrating and equalizing multiple microphone signals across different frequencies. An action 602 comprises receiving a plurality of microphone signals. The microphone signals may be provided by and received from a microphone array as described above. Each microphone signal has multiple frequency components, corresponding respectively to different frequencies, frequency bins, frequency bands, or frequency ranges.

An action 604 comprises obtaining a reference signal, which in some cases may comprise an audio signal from a reference microphone. An action 606 comprises determining reference energies based on the energies of different frequency components of the reference signal. More specifically, the action 606 may comprise determining the energies of the different frequency components of the reference signal, wherein the determined energies form reference energies corresponding respectively to the different frequency components of the microphone signals.

A set or sequence of actions 608 are performed with respect to each of the received microphone signals. However, in the case where one of the microphone signals is used as a reference signal, the actions 608 are not applied to the reference microphone signal.

A set or sequence of actions 610 are performed with respect to each frequency component of the microphone signal. An action 612 comprises determining an energy of the frequency component of the microphone signal. An action 614 comprises calculating a preliminary gain or sub-gain corresponding to the frequency component of the microphone signal. The preliminary gain or sub-gain may be based at least in part on the energy of the frequency component and the energy reference corresponding to the frequency component. More specifically, the preliminary gain may be calculated as the ratio of the energy reference to the energy of the frequency component.

An action 616 may be performed, comprising smoothing the preliminary gain over time to produce an adaptive signal gain. An action 618 comprises applying the adaptive gain to the frequency component of the microphone signal.

After compensating the multiple frequency components of the microphone signals in the actions 608 and 610, an action 620 comprises providing the compensated microphone signals to a sound processing component such as an audio beamformer or sound localization component.

Figure 7:
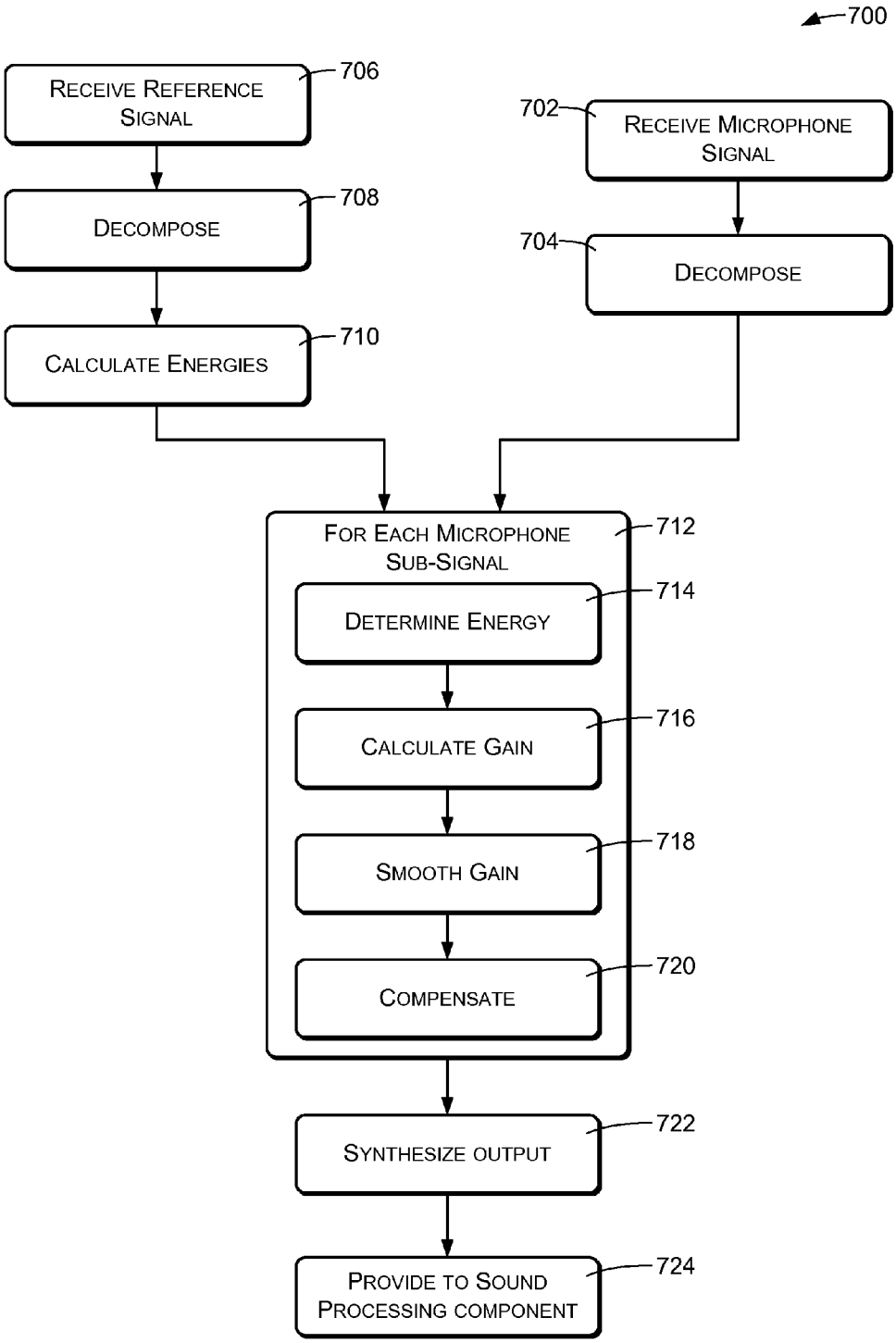
FIG. 7 is a flowchart illustrating an example of adaptively compensating different sub-signals of a microphone signal.

FIG. 7 illustrates another example method 700 of calibrating multiple microphone signals across different frequencies. An action 702 comprises receiving a microphone signal. The microphone signal may be provided by and received from a microphone array as described above. Although the method 700 is described with reference to a single microphone signal, it is to be understood that each of multiple microphone signals may be calibrated to a common reference signal in the same manner.

An action 704 comprises decomposing the microphone signal into a plurality of microphone sub-signals, corresponding respectively to different frequencies. Each microphone sub-signal represents a different frequency component of the microphone signal.

An action 706 comprises receiving a reference signal. In some cases, the reference signal may comprise a microphone signal that has been chosen from multiple microphone signals as a reference.

An action 708 comprises decomposing the reference signal into a plurality of reference sub-signals, corresponding respectively to the different frequencies. Each reference sub-signal represents a different frequency component of the reference signal.

An action 710 comprises calculating the energy of each reference sub-signal. The energy may be calculated over a block or frame of signal values as function of a sum of squares of the signal values of the block.

A set or sequence of actions 712 are performed with respect to each of the microphone sub-signals that result from the action 704. An action 714 comprises calculating the energy of the microphone sub-signal. The energy may be calculated over a block or frame of signal values as function of a sum of squares of the signal values of the block.

An action 716 comprises calculating a preliminary gain or sub-gain for the microphone sub-signal, which may be based at least in part on the energy of the microphone sub-signal and the energy of the reference sub-signal that corresponds to the frequency of the microphone sub-signal. More specifically, the preliminary gain may be calculated as the ratio of the energy of the reference sub-signal that corresponds to the frequency of the microphone sub-signal to the energy of the microphone sub-signal.

An action 718 comprises smoothing the preliminary gain over time to produce an adaptive signal gain corresponding to the microphone sub-signal.

An action 720 comprises applying the adaptive signal gain to the microphone sub-signal to produce a compensated microphone sub-signal. The action 720 may comprise amplifying or multiplying the microphone sub-signal by the adaptive signal gain that has been calculated for the microphone sub-signal.

After compensating the multiple microphone sub-signals in the actions 712, an action 722 comprises synthesizing the multiple resulting compensated microphone sub-signals to form a single, full frequency spectrum compensated microphone signal corresponding to the original input microphone signal. This may be accomplished by adding the multiple compensated microphone sub-signals.

An action 724 may be performed, comprising providing the compensated microphone signals to a sound processing component such as an audio beamformer or sound localization component. As described above, multiple microphone signals may be processed as shown by FIG. 7 with respect to a common reference signal and provided for use by a sound processing component.

Figure 8:
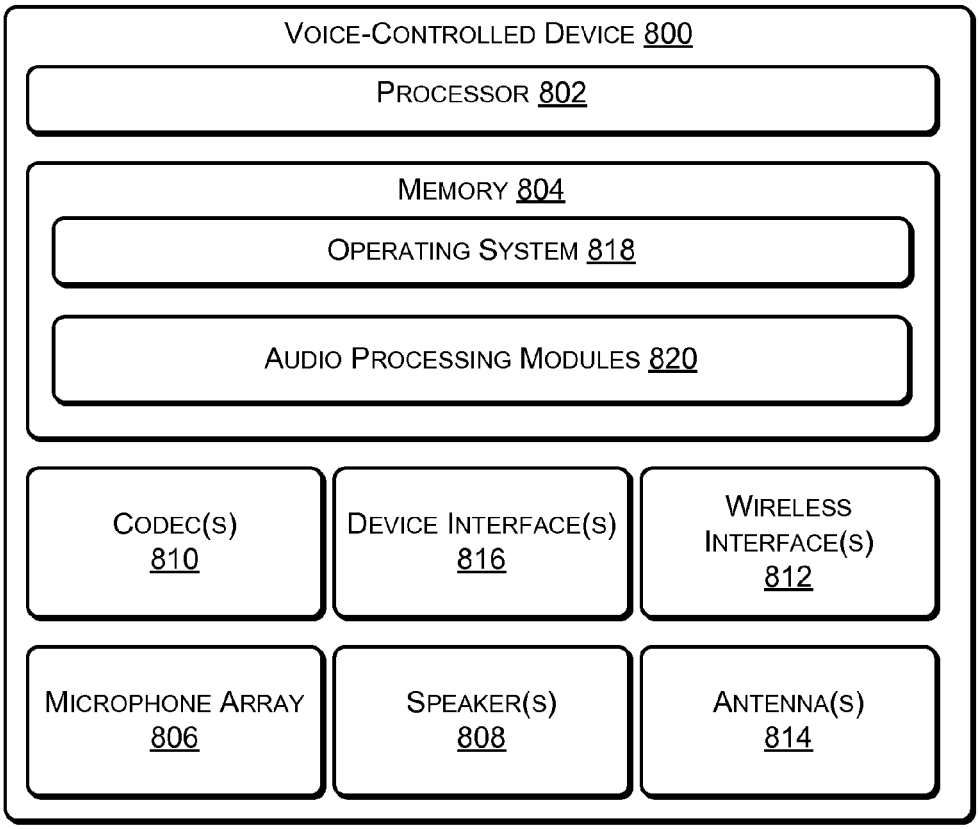
FIG. 8 is a block diagram illustrating an example system or device in which the techniques described herein may be implemented.

FIG. 8 shows an example of an audio system, element, or component that may be configured to perform adaptive microphone calibration and equalization in accordance with the techniques described above. In this example, the audio system comprises a voice-controlled device 800 that may function as an interface to an automated system. However, the devices and techniques described above may be implemented in a variety of different architectures and contexts. For example, the described microphone calibration and equalization may be used in various types of devices that perform audio processing, including mobile phones, entertainment systems, communications components, and so forth.

The voice-controlled device 800 may in some embodiments comprise a module that is positioned within a room, such as on a table within the room, which is configured to receive voice input from a user and to initiate appropriate actions in response to the voice input.

In the illustrated implementation, the voice-controlled device 800 includes a processor 802 and memory 804. The memory 804 may include computer-readable storage media ("CRSM"), which may be any available physical media accessible by the processor 802 to execute instructions stored on the memory 804. In one basic implementation, CRSM may include random access memory ("RAM") and flash memory. In other implementations, CRSM may include, but is not limited to, read-only memory ("ROM"), electrically erasable programmable read-only memory ("EEPROM"), or any other medium which can be used to store the desired information and which can be accessed by the processor 802.

The voice-controlled device 800 includes a microphone array 806 that comprises one or more microphones to receive audio input, such as user voice input. The device 800 also includes a speaker unit that includes one or more speakers 808 to output audio sounds. One or more codecs 810 are coupled to the microphones of the microphone array 806 and the speaker(s) 808 to encode and/or decode audio signals. The codec(s) 810 may convert audio data between analog and digital formats. A user may interact with the device 800 by speaking to it, and the microphone array 806 captures sound and generates one or more audio signals that include the user speech. The codec(s) 810 encodes the user speech and transfer that audio data to other components. The device 800 can communicate back to the user by emitting audible sounds or speech through the speaker(s) 808. In this manner, the user may interact with the voice-controlled device 800 simply through speech, without use of a keyboard or display common to other types of devices.

In the illustrated example, the voice-controlled device 800 includes one or more wireless interfaces 812 coupled to one or more antennas 814 to facilitate a wireless connection to a network. The wireless interface(s) 812 may implement one or more of various wireless technologies, such as wifi, Bluetooth, RF, and so forth.

One or more device interfaces 816 (e.g., USB, broadband connection, etc.) may further be provided as part of the device 800 to facilitate a wired connection to a network, or a plug-in network device that communicates with other wireless networks.

The voice-controlled device 800 may be designed to support audio interactions with the user, in the form of receiving voice commands (e.g., words, phrase, sentences, etc.) from the user and outputting audible feedback to the user. Accordingly, in the illustrated implementation, there are no or few haptic input devices, such as navigation buttons, keypads, joysticks, keyboards, touch screens, and the like. Further there is no display for text or graphical output. In one implementation, the voice-controlled device 800 may include non-input control mechanisms, such as basic volume control button(s) for increasing/decreasing volume, as well as power and reset buttons. There may also be one or more simple light elements (e.g., LEDs around perimeter of a top portion of the device) to indicate a state such as, for example, when power is on or to indicate when a command is received. But, otherwise, the device 800 does not use or need to use any input devices or displays in some instances.

Several modules such as instruction, datastores, and so forth may be stored within the memory 804 and configured to execute on the processor 802. An operating system module 818, for example, may be configured to manage hardware and services (e.g., wireless unit, Codec, etc.) within and coupled to the device 800 for the benefit of other modules. In addition, the memory 804 may include one or more audio processing modules 820, which may be executed by the processor 802 to perform the methods described herein, as well as other audio processing functions.

Although the example of FIG. 8 shows a programmatic implementation, the functionality described above may be performed by other means, including non-programmable elements such as analog components, discrete logic elements, and so forth. Thus, in some embodiments various ones of the components, functions, and elements described herein may be implemented using programmable elements such as digital signal processors, analog processors, and so forth. In other embodiments, one or more of the components, functions, or elements may be implemented using specialized or dedicated circuits. The term "component", as used herein, is intended to include any hardware, software, logic, or combinations of the foregoing that are used to implement the functionality attributed to the component.

Although the discussion above sets forth example implementations of the described techniques, other architectures may be used to implement the described functionality, and are intended to be within the scope of this disclosure. Furthermore, although specific distributions of responsibilities are defined above for purposes of discussion, the various functions and responsibilities might be distributed and divided in different ways, depending on circumstances.

Furthermore, although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A device, comprising:

a microphone array comprising a plurality of microphones configured to produce a respective plurality of microphone signals;

one or more microphone compensators corresponding to one or more of the plurality of microphone signals, the one or more microphone compensators configured to receive an energy reference signal and a corresponding microphone signal, and configured to:

for each of a plurality of frequencies:

determine an energy of the received microphone signal;

determine a gain associated with the received microphone signal, wherein the gain is based on a ratio of an energy of the energy reference signal and the energy of the received microphone signal; and produce a compensated microphone signal by applying the gain to the received microphone signal; and a sound processor comprising one or more of the following:

an audio beamformer configured to process each compensated microphone signal to produce one or more directional audio signals respectively representing sound received from one or more directions relative to the microphone array; or a sound localizer configured to analyze the compensated microphone signals to determine one or more positional coordinates of a location of origin of sound received by the microphone array.

2. The device of claim 1, wherein the one or more microphone compensators is further configured to determine the energy of the received microphone signal by averaging squared amplitude values of the received microphone signal.

3. The device of claim 1, wherein the one or more microphone compensators is further configured to determine the energy of the received microphone signal by averaging absolute amplitude values of the received microphone signal.

4. The device of claim 1, further comprising a reference generator that is responsive to one of the microphone signals to produce the energy reference signal by estimating an energy of said one of the microphone signals.

5. The device of claim 1, further comprising:

a reference generator configured to:

decompose the energy reference signal into a first reference sub-signal corresponding to a first frequency;

decompose the energy reference signal into a second reference sub-signal corresponding to a second frequency;

estimate a first energy value for the first reference sub-signal; and estimate a second energy value for the second reference sub-signal;

the one or more microphone compensators further configured to:

decompose the received microphone signal into a first microphone sub-signal corresponding to the first frequency;

decompose the received microphone signal into a second microphone sub-signal corresponding to the second frequency;

estimate a third energy value for the first microphone sub-signal;

estimate a fourth energy value for the second microphone sub-signal;

calculate a first gain corresponding to the first frequency as a ratio of the first energy value and the third energy value;

calculate a second gain corresponding to the second frequency as a ratio of the second energy value and the fourth energy value;

apply the first gain to the first microphone sub-signal to generate a modified first microphone sub-signal;

apply the second gain to the second microphone sub-signal to generate a modified second microphone sub-signal; and combine the modified first and second microphone sub-signals to create the compensated microphone signal.

6. A method, comprising:

receiving a plurality of microphone signals;

receiving a reference signal;

estimating an energy of each microphone signal at each of a plurality of frequencies;

estimating an energy of the reference signal at each of the plurality of frequencies; and for each microphone signal, at each frequency, modifying the microphone signal based at least in part on (a) the estimated energy of the microphone signal at the frequency and (b) the estimated energy of the reference signal at the frequency.

7. The method of claim 6, further comprising providing the microphone signals to at least one of an audio beamformer or a sound source localizer.

8. The method of claim 6, wherein estimating the energy of a particular one of the microphone signals comprises averaging squared amplitude values of the particular microphone signal.

9. The method of claim 6, wherein the reference signal is received from a reference microphone.

10. The method of claim 6, wherein modifying the microphone signal comprises:

calculating a gain as a ratio of (a) the estimated energy of the reference signal at the frequency and (b) the estimated energy of the microphone signal at the frequency; and modifying the microphone signal as a function of the gain.

11. The method of claim 6, further comprising:

decomposing each microphone signal into a plurality of microphone sub-signals corresponding respectively to each of the plurality of frequencies; and decomposing the reference signal into a plurality of reference sub-signals corresponding respectively to each of the plurality of frequencies.

12. A method, comprising:

receiving a plurality of microphone signals;

obtaining an energy reference signal;

for each of a plurality of frequencies:

determining an energy of one or more microphone signals of the plurality of microphone signals;

determining a gain for the one or more microphone signals based at least in part on (a) the determined energy of the one or more microphone signals and (b) an energy of the energy reference signal; and modifying the one or more microphone signals as a function of the determined gain to produce corresponding one or more modified microphone signals.

13. The method of claim 12, further comprising providing the one or more modified microphone signals to at least one of an audio beamformer or a sound source localizer.

14. The method of claim 12, wherein obtaining the energy reference signal comprises:

receiving a reference signal from a reference microphone; and estimating an energy of the reference signal.

15. The method of claim 12, wherein obtaining the energy reference signal comprises:

receiving a reference signal from a reference microphone; and estimating energies of the reference signal at different frequencies.

16. The method of claim 12, wherein obtaining the energy reference signal comprises receiving an energy reference value.

17. The method of claim 12, wherein determining the energy of the one or more microphone signals comprises averaging squared amplitude values of the one or more microphone signals.

18. The method of claim 12, wherein the one or more microphone signals has multiple frequency components, the method further comprises:

for each of the multiple frequency components:

obtaining an energy reference signal;

determining an energy of the respective frequency component; and determining a gain for the respective frequency component, wherein the gain is based at least in part on the energy reference signal corresponding to the respective frequency component and the determined energy of the respective frequency component; and modifying the one or more microphone signals as a function of the gain calculated for each of the multiple frequency components.

19. The method of claim 18, wherein obtaining the energy reference signal corresponding to the respective frequency component comprises:

receiving a reference microphone signal having multiple frequency components; and determining an energy of each frequency component of the multiple frequency components of the reference microphone signal.

* * * * *